US008240266B2

(12) United States Patent
Cole

(10) Patent No.: US 8,240,266 B2
(45) Date of Patent: Aug. 14, 2012

(54) MOORING APPARATUS

(76) Inventor: David Arthur Cole, Jersey (GB)

( * ) Notice: Subject to any disclaimer, the term of this patent is extended or adjusted under 35 U.S.C. 154(b) by 155 days.

(21) Appl. No.: 12/682,506

(22) PCT Filed: Sep. 26, 2008

(86) PCT No.: PCT/GB2008/003281

§ 371 (c)(1),
(2), (4) Date: Jun. 3, 2010

(87) PCT Pub. No.: WO2009/044110

PCT Pub. Date: Apr. 9, 2009

(65) Prior Publication Data

US 2010/0242822 A1 Sep. 30, 2010

(30) Foreign Application Priority Data

Oct. 2, 2007 (GB) ..... 0719197.6

(51) Int. Cl.
*B63B 21/00* (2006.01)

(52) U.S. Cl. ..... 114/230.2

(58) Field of Classification Search ..... 114/230.2, 114/254, 230.23

See application file for complete search history.

(56) References Cited

U.S. PATENT DOCUMENTS

| | | | | |
|---|---|---|---|---|
| 2,203,433 | A | 6/1940 | Gundian | |
| 4,387,659 | A | 6/1983 | Terauchi et al. | |
| 4,531,470 | A | 7/1985 | Paul | |
| 4,627,759 | A | 12/1986 | Kato et al. | |
| 5,632,219 | A * | 5/1997 | Fleming, Jr. | 114/254 |
| 5,957,075 | A | 9/1999 | Byrne, Sr. et al. | |
| 2005/0284355 | A1 * | 12/2005 | Toth | 114/230.1 |
| 2009/0255100 | A1 | 10/2009 | Stone | |

FOREIGN PATENT DOCUMENTS

| | | |
|---|---|---|
| AU | 486325 B2 | 6/1976 |
| GB | 868847 | 5/1961 |
| GB | 978682 | 12/1964 |
| GB | 1 350 585 A | 4/1974 |
| JP | 59-216782 A | 6/1984 |

* cited by examiner

*Primary Examiner* — Stephen Avila
(74) *Attorney, Agent, or Firm* — Leydig, Voit & Mayer, Ltd.

(57) ABSTRACT

A mooring apparatus (2) including a frame (4), a mooring wheel (6) and a locking system, wherein the mooring wheel includes a circumferentially located mooring rope engagement portion and is rotatably coupled to the frame; and the locking system is adapted to prevent rotation of the mooring wheel when in a locked configuration and to permit rotation of the mooring wheel when in a released configuration, whereby when the locking system is in the locked position, the mooring wheel is configured such that the forces exerted by a mooring rope against the mooring apparatus act along an axis which passes substantially through a rotational axis of the mooring wheel.

20 Claims, 2 Drawing Sheets

MOORING APPARATUS

The present invention relates to a mooring apparatus for mooring ships at a jetty.

It is known to provide a mooring apparatus about which a mooring rope from a ship can be releasably retained. However, these all tend to suffer from at least one problem.

For example, one known type of apparatus includes a retaining element in the form of pivotable prongs which have a locked position and a release position. In the locked position, the prongs are substantially vertical and in the release position, they are either substantially horizontal or the distal ends of the prongs are allowed to fall to the ground. One problem with this type of apparatus is that the mooring rope typically needs to be exerting a significant force on the prongs before they can be released. This delays the release of the mooring rope in situations where the rope has gone slack and is not exerting sufficient force on the prongs. In addition, the apparatus needs a locking mechanism which is capable of resisting the force exerted on the prongs by the mooring rope. This may be ninety tons or more. Furthermore, after the ship has left its mooring, an operator has to re-set manually the prongs to the locked position. The prongs are typically very heavy and for large moorings, there may be up to sixteen mooring apparatus which need to be re-set. This is clearly a very onerous task.

The present invention sets out to address or ameliorate at least some of the known problems with mooring apparatus.

According to the present invention, there is provided a mooring apparatus including a frame, a mooring wheel and a locking system, wherein the mooring wheel includes a circumferentially located mooring rope engagement portion and is rotatably coupled to the frame; and the locking system is adapted to prevent rotation of the mooring wheel when in a locked configuration and to permit rotation of the mooring wheel when in a released configuration, whereby when the locking system is in the locked position, the mooring wheel is configured such that the forces exerted by a mooring rope against the mooring apparatus act along an axis which passes substantially through a central axis of the mooring wheel.

By having a mooring wheel about which a mooring rope is placed in use, the release of the mooring rope simply results in rotation of the wheel, which is easy to re-set in a locked configuration. It is possible to have the wheel return to its locked configuration automatically after release of the mooring rope. This may be achieved, for example, by weighting of the mooring wheel or by the use of a motorised rotational drive system coupled to the wheel.

In addition, by having the forces exerted by the mooring rope in use pass through the centre of the mooring wheel, the mooring rope exerts little or no turning force or torque on the wheel. This means that the locking device needs only to prevent rotation of the wheel, rather than resist the entire force exerted by the mooring rope in use. Accordingly, a less robust and consequently less complicated locking system is required to prevent the unintentional release of the mooring rope from the mooring system.

This is of particular benefit in situations where emergency release of the mooring ropes is necessary. As the locking system may be a relatively lightweight system, it can be released with relatively little force.

Furthermore, the mooring ropes can be released from the mooring system regardless of what forces they are exerting. There is no need for a minimum threshold force to be exerted before release can occur.

Throughout this specification, the terms "central axis of the mooring wheel" and "rotational axis of the mooring wheel" are used interchangeably and the terms should be considered to be synonymous.

In an embodiment of the invention, the mooring rope engagement portion comprises a radially inwardly projecting indent. The indent is typically arranged such that when the mooring wheel is locked, the indent faces rearwards (i.e. away from the ship being moored) and is arranged such that a mooring rope engaged with the indent passes substantially through the rotational axis (the axis about which the mooring wheel rotates) of the mooring wheel. In other words, the rope passes around the outside of the frame and substantially through the axis defined by an axle about which the wheel rotates when in an unlocked configuration.

The mooring rope typically includes an end loop which is passed around the mooring wheel in use. In this case, the indent is arranged such that each of the opposing sides of the loop passes adjacent a respective outwardly facing surface of the frame, substantially through the rotational axis of the mooring wheel. Thus, the end loop of the mooring rope envelopes a portion of the frame.

The indent may prevent the mooring rope from slipping out of alignment with the rotational axis of the mooring wheel.

In a further embodiment, the frame includes a guide element arranged to configure a mooring rope in use such that the forces exerted by the mooring rope act along an axis which substantially passes through the rotational axis of the mooring wheel.

A skilled person will appreciate that ships when moored can rise and fall relative to a fixed jetty. This clearly can change the angle of the mooring ropes relative to the jetty and thus can move the axis along which the mooring rope exerts its force relative to the mooring apparatus. In order to prevent the mooring rope from exerting more than a minimal torque or turning force on the mooring wheel, the guide element is capable of maintaining the axis along which the forces exerted by the mooring rope act constant with respect to the mooring apparatus.

The guide may also cancel out any differences in height of the ships being moored and therefore maintain as constant the angle of the mooring rope relative to the mooring apparatus.

As the mooring rope exerts relatively little or no torque on the mooring wheel, the locking apparatus can be less robust than locking systems which are designed to directly counter the forces exerted by the mooring ropes. As such, the locking system of the present invention may comprise a primary locking element which is adapted to releasably engage a complimentary socket located on the mooring wheel. This relatively simple arrangement is easy to make and easy to release. For example, the primary locking element may be biased towards the mooring wheel such that when it is aligned with the socket, it automatically engages the socket and prevents the wheel from turning further.

In a further embodiment, the primary locking element may include a domed end portion which engages a corresponding socket or recess. In this case, any torque exerted on the mooring wheel would urge the primary locking element out of engagement with the socket. To prevent the disengagement of the primary locking element in this embodiment, a secondary locking element is provided, which in a locked position prevents the primary locking element from disengaging from its socket, and in a release position, allows the disengagement of the primary locking element. As an optional alternative to the domed end portion, the end portion of the primary locking element may include a slanted or beveled surface which achieves a similar effect, namely it is capable of engaging a corresponding socket, but is urged out of engagement upon rotation of the mooring wheel.

Such an arrangement provides a quick release mechanism for the mooring apparatus. The secondary locking element requires relatively little force to be arranged in the release position and then any torque exerted on the mooring wheel above a threshold value would urge the primary locking element out of engagement with its socket and allow the mooring wheel to rotate, thus releasing the mooring rope.

In a still further embodiment of the invention, the frame of the mooring apparatus is rotatably coupled to a capstan housing located on a jetty such that the frame is free to rotate relative to the capstan housing in a horizontal plane.

Jetties alongside which ships are moored tend to include capstans which are capable of receiving a heaving line and which include motors to draw across the mooring rope via the heaving line. The capstans are typically secured to the jetty via a capstan housing and the capstan housing provides a suitable base to which the mooring apparatus may be secured.

As ships of various different lengths may be moored to the jetty, the angle between the mooring rope and the jetty may vary in the horizontal plane. In order to accommodate these different angles, the mooring apparatus may be rotatably coupled to the capstan housing.

The skilled person will appreciate that the features of the embodiments described above are not mutually exclusive and as such, they can be combined in various ways. Thus, the invention includes all possible combinations of the optional features described herein and is not limited to the specific embodiments described above.

A specific embodiment of the invention will now be described by way of example only with reference to the accompanying drawings in which.

Figure 1:
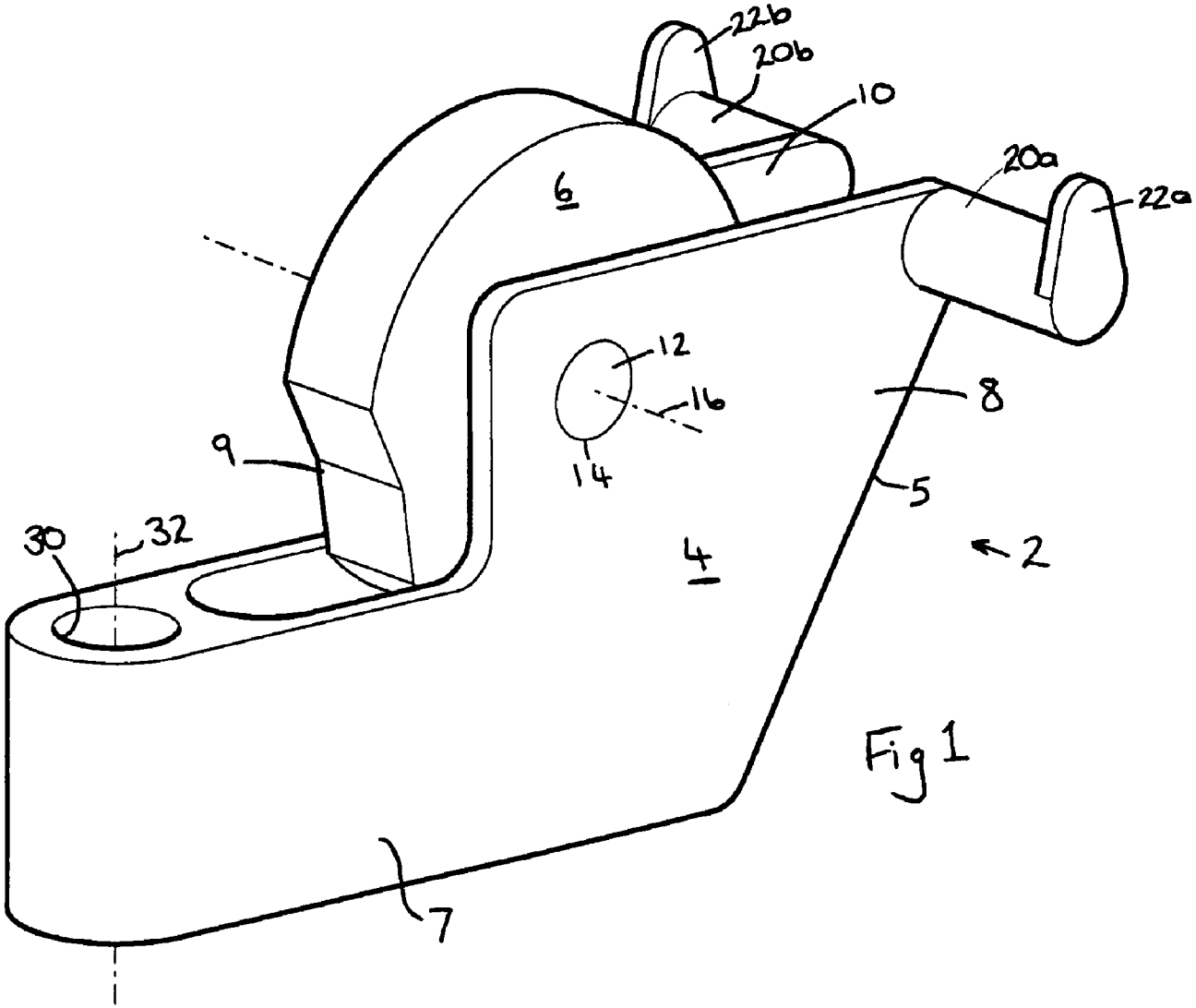
FIG. 1 is perspective view of a mooring apparatus according to the invention.

For the avoidance of doubt, reference to up, down, left, right, horizontal, vertical, etc. relates to the orientation of the apparatus as shown in the drawings.

A mooring apparatus 2 according to the invention is shown in FIG. 1. The apparatus 2 comprises a frame 4, a mooring wheel 6 and a locking system (not shown).

The frame 4 consists of a substantially U-shaped body 5 which defines two opposing parallel sides 8, 10. At the front end of the frame (i.e. the end which faces towards a moored ship) is provided a pair of horizontal mooring rope guide elements 20*a*, 20*b*. Each of the guide elements terminates at its distal end in an upwardly extending end plate 22*a*, 22*b*.

The frame 4 includes opposing apertures 14 in the sides 8, 10 within which is located an axle 12. The axle defines a horizontal axis 16.

Towards the rear end of the frame is provided an area 7 of reduced height and at the rear of the frame is provided a vertical aperture 30 which defines a vertical axis 32.

A mooring wheel 6 is rotatably coupled to the axle 12 and is arranged such that part of the wheel 6 is located between the frame sides 8, 10 and that a part of the wheel 6 which is substantially rearward facing is exposed by virtue of the area 7 of the frame having reduced height. As shown in FIG. 1, the rearward facing portion of the wheel includes a radially inwardly extending indent 9 having a shallow V-shape.

Figure 2:
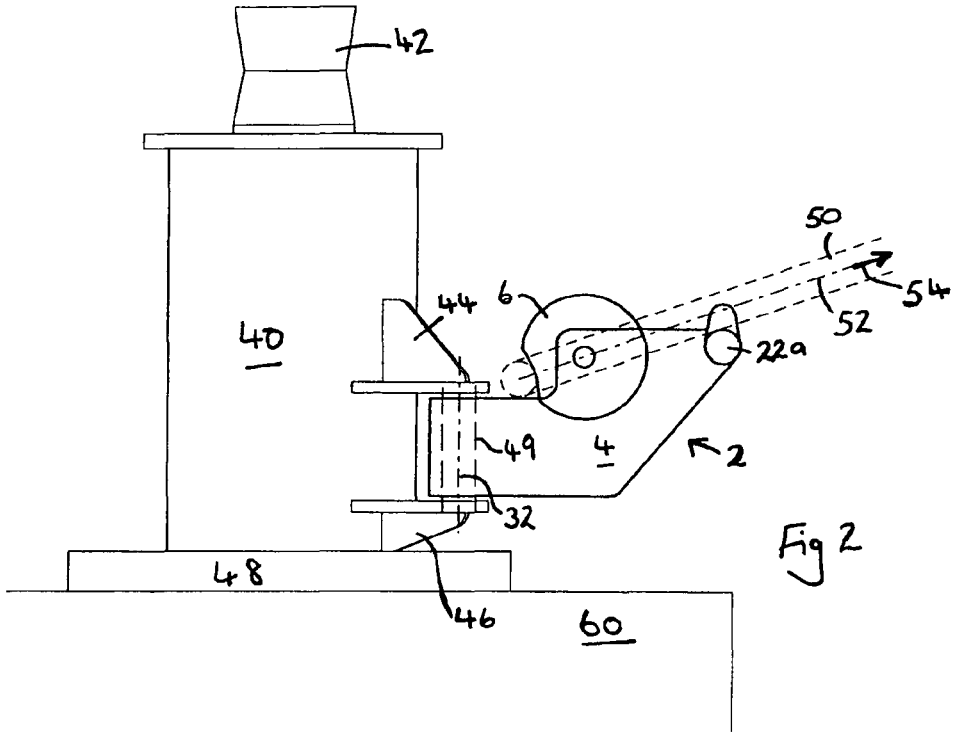
FIG. 2 is a side elevational view of the mooring apparatus rotatably coupled to a capstan housing secured to a jetty.
Figure 3:
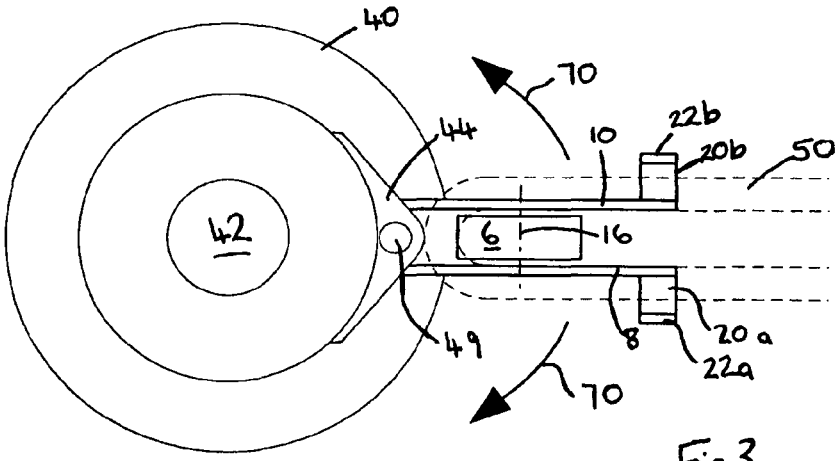
FIG. 3 is a plan view of the arrangement shown in FIG. 2.

FIG. 2 shows the mooring apparatus 2 pivotally coupled to a capstan mounting 40 via an axle 49. The axle 49 is journalled within carriers 44, 46 which are secured to the capstan mounting 40. The mooring apparatus 2 is arranged in such a way that it is capable of pivoting relative to the capstan mounting 40 in a horizontal plane, shown by arrows 70 in FIG. 3.

The capstan mounting 40 is secured to a jetty 60 via a base plate 48 and carries a capstan 42. Located within the capstan mounting 40 is a motor (not shown) which drives the capstan 42 to rotate.

The mooring apparatus includes a locking system (not shown) which is adapted to lock the mooring wheel against rotation when the locking system is engaged. The locking system includes a primary lock element which includes a domed end portion sized and configured to fit partially within a complimentary aperture within the mooring wheel 6. With this arrangement, a rotational force exerted by the mooring wheel urges the primary lock element out of engagement with the aperture. However, unintentional disengagement of the primary lock element from the mooring wheel aperture is prevented by a second lock element which prevents the disengagement when in a lock position and permits the disengagement when in a release position. The arrangement of the first and second lock elements results in a locking system which is able to resist a relatively large rotational force from the mooring wheel, but requires relatively little force to release the wheel and permit its rotation.

The skilled man will, of course, appreciate that this type of locking device is known generally in other applications and as such is not described herein in detail. Alternative arrangements for the primary lock element could be used with the present invention. For example, the primary lock element could comprise an angled end portion instead of a domed end portion, wherein the angled end portion is capable of being received into a correspondingly shaped recess in the mooring wheel 6. The essential feature of the primary lock element is that it is capable of preventing rotation of the mooring wheel 6 when engaged with a complimentary lock receiving aperture or recess in the mooring wheel 6, and that a torque exerted by the mooring wheel 6 is capable of urging the primary lock element out of engagement with the mooring wheel 6 when a secondary lock element is in a release position.

The locking system is arranged to lock the mooring wheel 6 such that a relatively small torque is exerted by a mooring rope 50 on the mooring wheel 6 in the clockwise direction as shown in FIG. 2. This allows easy release of the mooring rope 50 as will be described below and prevents the mooring rope 50 becoming jammed between the indent 9 of the mooring wheel 6 and the frame 4.

In use, the capstan 42 pulls across the mooring rope 50 via a heaving line. The mooring rope 50 is located around the mooring wheel 6 such that it engages the indent 9. The mooring wheel 6 is locked in position with the mooring rope 50 having its centre line (shown by the dotted line 52) ideally passing substantially through the horizontal axis 16. In this way, the force (shown by arrow 54) exerted by the mooring rope 50 on the mooring wheel passes through its rotational axis and as such exerts little or no torque on the mooring wheel. In practice, however, the centre line 52 of the mooring rope 50 (and hence the force 54 exerted by the rope 50 on the mooring apparatus 2) passes slightly above the horizontal axis 16. This results in a relatively small turning force exerted by the mooring rope 50 on the mooring wheel 6 (in a clockwise direction for the arrangement shown in FIG. 2). This relatively small torque exerted on the mooring wheel 6 is useful when it comes to releasing the mooring rope 50 (see below).

In order to accommodate ships of differing length, the mooring apparatus 2 pivots in a horizontal plane about the capstan mounting such that the apparatus is able to face towards the relevant mooring point of the ship.

To release the mooring rope 50, an operator positions the second lock element in its release position. This allows the relatively small rotational force exerted by the mooring rope 50 on the mooring wheel 6 to urge the primary lock element out of engagement with its corresponding aperture and causes the mooring wheel to rotate (clockwise as shown in FIG. 2). This rotation causes the mooring rope 50 to separate from the mooring apparatus 2.

The mooring wheel 6 is weighted such that it returns to its rest position with the indent 9 facing rearwards once the mooring rope 50 is released.

The invention claimed is:

1. A mooring apparatus including a frame, a mooring wheel and a locking system, wherein the mooring wheel includes a circumferentially located mooring rope engagement portion in the form of a radially inwardly projecting indent formed in a portion of the circumference of the mooring wheel; the mooring wheel is rotatably coupled to the frame; and the locking system is adapted to prevent rotation of the mooring wheel when in a locked configuration and to permit rotation of the mooring wheel when in a released configuration, whereby when the locking system is in the locked position, the mooring wheel is configured such that the mooring rope engagement portion is rearward facing and the forces exerted by a mooring rope located within the engagement portion and arranged radially around mooring wheel against the mooring apparatus act along an axis which passes substantially through a rotational axis of the mooring wheel.

2. A mooring apparatus according to claim 1, wherein the frame includes a guide element arranged to configure a mooring rope in use such that the forces exerted by the mooring rope act along an axis which substantially passes through the rotational axis of the mooring wheel.

3. A mooring apparatus according to claim 1, wherein the locking system comprises a primary locking element which is adapted to releasably engage a complimentary socket located on the mooring wheel.

4. A mooring apparatus according to claim 3, wherein the primary locking element comprises a domed engagement portion and the locking system includes a secondary locking element having a locked position in which removal of the domed engagement portion from the socket is prevented and a release position in which removal of the domed engagement portion from the socket is permitted.

5. Mooring apparatus according to claim 1, wherein the frame of the mooring apparatus is rotatably coupled to a capstan housing located on a jetty such that the frame is free to rotate relative to the capstan housing in a horizontal plane.

6. A mooring apparatus according to claim 1, wherein the frame includes a guide element arranged to configure a mooring rope in use such that the forces exerted by the mooring rope act along an axis which substantially passes through the rotational axis of the mooring wheel.

7. A mooring apparatus according to claim 1, wherein the locking system comprises a primary locking element which is adapted to releasably engage a complimentary socket located on the mooring wheel.

8. A mooring apparatus according to claim 2, wherein the locking system comprises a primary locking element which is adapted to releasably engage a complimentary socket located on the mooring wheel.

9. Mooring apparatus according to claim 1, wherein the frame of the mooring apparatus is rotatably coupled to a capstan housing located on a jetty such that the frame is free to rotate relative to the capstan housing in a horizontal plane.

10. Mooring apparatus according to claim 2, wherein the frame of the mooring apparatus is rotatably coupled to a capstan housing located on a jetty such that the frame is free to rotate relative to the capstan housing in a horizontal plane.

11. Mooring apparatus according to claim 3, wherein the frame of the mooring apparatus is rotatably coupled to a capstan housing located on a jetty such that the frame is free to rotate relative to the capstan housing in a horizontal plane.

12. Mooring apparatus according to claim 4, wherein the frame of the mooring apparatus is rotatably coupled to a capstan housing located on a jetty such that the frame is free to rotate relative to the capstan housing in a horizontal plane.

13. A mooring apparatus according to claim 7, wherein the primary locking element comprises a domed engagement portion and the locking system includes a secondary locking element having a locked position in which removal of the domed engagement portion from the socket is prevented and a release position in which removal of the domed engagement portion from the socket is permitted.

14. A mooring apparatus according to claim 8, wherein the primary locking element comprises a domed engagement portion and the locking system includes a secondary locking element having a locked position in which removal of the domed engagement portion from the socket is prevented and a release position in which removal of the domed engagement portion from the socket is permitted.

15. Mooring apparatus according to claim 13, wherein the frame of the mooring apparatus is rotatably coupled to a capstan housing located on a jetty such that the frame is free to rotate relative to the capstan housing in a horizontal plane.

16. Mooring apparatus according to claim 14, wherein the frame of the mooring apparatus is rotatably coupled to a capstan housing located on a jetty such that the frame is free to rotate relative to the capstan housing in a horizontal plane.

17. A mooring apparatus including a frame, a mooring wheel and a locking system, wherein the mooring wheel includes a circumferentially located mooring rope engagement portion and is rotatably coupled to the frame; the locking system comprises a primary locking element having a domed engagement portion, the primary locking element being adapted to releasably engage a complimentary socket located on the mooring wheel; the locking system including a secondary locking element having a locked position in which removal of the domed engagement portion from the socket is prevented and a release position in which removal of the domed engagement portion from the socket is permitted; the locking system being adapted to prevent rotation of the mooring wheel when in a locked configuration and to permit rotation of the mooring wheel when in a released configuration, whereby when the locking system is in the locked position, the mooring wheel is configured such that the forces exerted by a mooring rope against the mooring apparatus act along an axis which passes substantially through a rotational axis of the mooring wheel.

18. A mooring apparatus according to claim 17, wherein the frame of the mooring apparatus is rotatably coupled to a capstan housing located on a jetty such that the frame is free to rotate relative to the capstan housing in a horizontal plane.

19. A mooring apparatus including a frame, a mooring wheel and a locking system, wherein the frame includes a guide element, the mooring wheel includes a circumferentially located mooring rope engagement portion and is rotatably coupled to the frame; the locking system comprises a primary locking element having a domed engagement portion, the primary locking element being adapted to releasably engage a complimentary socket located on the mooring wheel; the locking system including a secondary locking element having a locked position in which removal of the domed engagement portion from the socket is prevented and a release position in which removal of the domed engagement portion from the socket is permitted; and the locking system is adapted to prevent rotation of the mooring wheel when in a locked configuration and to permit rotation of the mooring wheel when in a released configuration, whereby when the locking system is in the locked position, the guide element and the mooring wheel being configured such that the forces exerted by a mooring rope against the mooring apparatus act along an axis which passes substantially through a rotational axis of the mooring wheel.

20. A mooring apparatus according to claim 19, wherein the frame of the mooring apparatus is rotatably coupled to a capstan housing located on a jetty such that the frame is free to rotate relative to the capstan housing in a horizontal plane.

* * * * *